US005899302A

United States Patent [19]

O'Donnell

[11] Patent Number: 5,899,302

[45] Date of Patent: May 4, 1999

[54] ELEVATOR DOOR INTERLOCK

[75] Inventor: Timothy P. O'Donnell, Delray Beach, Fla.

[73] Assignee: Vertisys, Inc., Boca Raton, Fla.

[21] Appl. No.: 08/857,538

[22] Filed: May 16, 1997

[51] Int. Cl.[6] ..... B66B 13/14

[52] U.S. Cl. ..... 187/314; 187/335

[58] Field of Search ..... 187/314, 324, 187/334, 335, 330, 331, 319; 49/116, 120

[56] References Cited

U.S. PATENT DOCUMENTS

| | | | |
|---|---|---|---|
| 3,912,049 | 10/1975 | Holland et al. | 187/61 |
| 4,313,525 | 2/1982 | McDonald | 187/57 |
| 4,423,799 | 1/1984 | Glaser et al. | 187/57 |
| 5,377,785 | 1/1995 | Pearson | 187/308 |

*Primary Examiner*—Kenneth Noland

*Attorney, Agent, or Firm*—Brooks & Kushman P.C.

[57] ABSTRACT

An elevator door interlock includes a position indicator mounted at each landing, an elongate vane pivotally mounted in a fixed position with respect to the car door for movement between a first position, preferably several degrees rotated from perpendicular, and a second position, preferably generally perpendicular to the door surface, a swing latch including a latch arm secured at one end to the vane, preferably extending generally perpendicular to the vane, a contact plate secured to the end of the swing latch opposite the vane end, and a stop plate mounted in a fixed position with respect to the elevator car. The vane is preferably mounted on a spring-biased hinge, and is normally biased towards the first position such that the contact plate extends into the plane of the stop plate and contacts the stop plate to prevent further opening of the elevator door more than a limited distance when the door is opened unless the elevator car door is moved into a safe landing position within the hoistway.

8 Claims, 6 Drawing Sheets

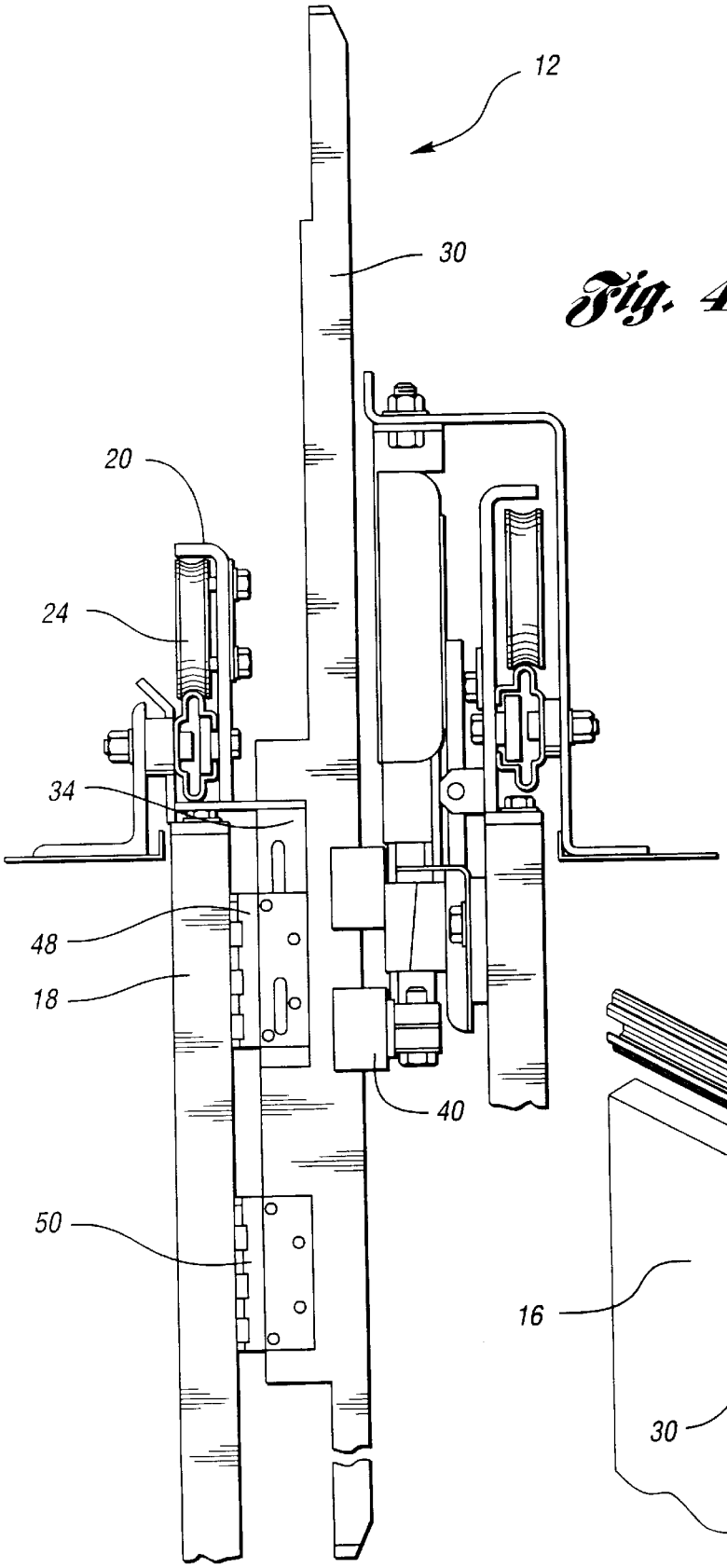
Fig. 4
Fig. 5
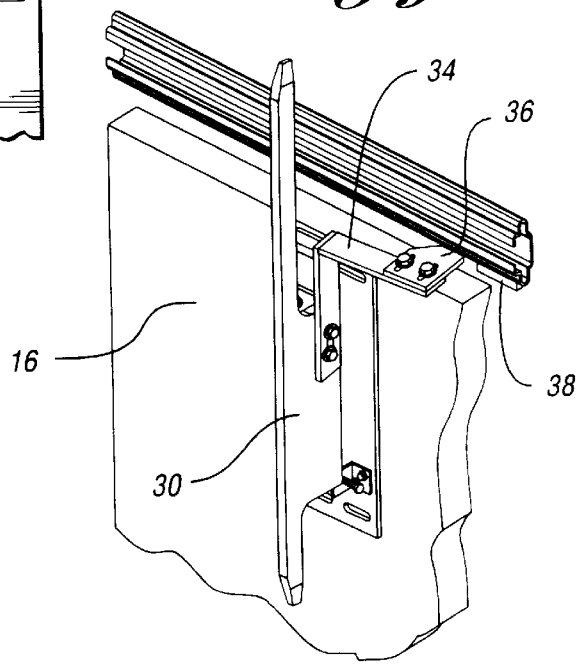

ELEVATOR DOOR INTERLOCK

TECHNICAL FIELD

This invention relates to an elevator door interlock which may be employed with existing elevator door operators to mechanically restrain the doors from opening more than a limited distance unless the elevator car is in a landing zone.

BACKGROUND ART

An ongoing concern in the elevator industry is the situation where an elevator car stops between floors due to a power failure, equipment breakdown, or for some other unforeseen circumstance. Existing codes require that either the elevator car doors or hoistway doors cannot be opened more than four inches from inside the car whenever the car is outside the landing zone. These standard codes also require that when the car door is arranged so that it cannot be opened, the car door shall be openable from outside the car without the use of special tools.

Elevators typically employ door coupling mechanisms which mechanically couple the car doors to access doors located at the passenger landings, so that both the car door and the access door can be simultaneously and jointly controlled to open or close to allow for entry and exit of passengers. One such existing door coupling mechanism is the blade-and-roller-type mechanism employed on elevators manufactured by Otis Elevator Company. This coupling mechanism is illustrated in FIGS. 1 and 2.

Various mechanical car door locking systems have been developed which are integrated with the car door coupling mechanism. One example, shown in U.S. Pat. No. 1,326,440, entitled "Apparatus for Operating an Interlocking Landing in Cage Gates of Elevators," issued to Shaudoir, shows an elevator/hoistway door coupling mechanism employing a mechanical interlock which prevents the elevator door and/or hoistway door from opening unless the elevator car is in the desired position at a hoistway landing.

Another example, U.S. Pat. No. 4,313,525, entitled "Car Door Safety Interlock," issued to McDonald, discloses a power operating sliding door of an elevator car which is provided with a mechanical safety interlock which restrains the elevator car door from opening unless disengaged through a mechanical interconnection responsive to the motion of a door coupling vane contacting a pair of hatch door rollers.

U.S. Pat. No. 4,423,799, entitled "Vehicle Door Lock for Limiting Door Opening to Specified Vehicle Positions," issued to Glaser, et al., similarly discloses a variety of locking mechanisms which restrain elevator car doors from opening unless disengaged as an indirect result of the engagement of the elevator car door/hoistway door coupling mechanism.

These and other existing mechanical interlock systems, however, typically utilize several interconnected moving parts and are difficult or impossible to retrofit on existing elevator systems.

One object of the present invention is, therefore, to provide a mechanical car door interlock which employs few moving parts.

Another object of the present invention is to provide a mechanical car door restraint which is integrated with a conventional blade-and-roller type door coupling mechanism so that the elevator door coupling vane serves the additional functions of position sensor and actuator for the elevator car door interlock.

It is yet another object of the present invention to provide a mechanical door interlock which is simple in design and operation, to facilitate easy installation, service, and retrofitting of the device onto existing elevator systems.

It is yet another object of the present invention to provide a mechanical door interlock which may be quickly and easily disengaged from outside the elevator car.

DISCLOSURE OF THE INVENTION

In carrying out the above and other objects, the elevator door interlock of the present invention includes a position indicator mounted at each landing, an elongate vane pivotally mounted in a fixed position with respect to the car door for movement between a first position, preferably several degrees rotated from perpendicular, and a second position, preferably generally perpendicular to the door surface, a swing latch including a latch arm secured at one end to the vane, preferably extending generally perpendicular to the vane, a contact plate secured to the end of the swing latch opposite the vane end, and a stop plate mounted in a fixed position with respect to the elevator car. The vane is preferably mounted on a spring-biased hinge, and is normally biased towards the first position such that the contact plate extends into the plane of the stop plate. The contact plate contacts the stop plate to prevent further opening of the elevator door more than a limited distance when the door is opened unless the elevator car door is moved into a safe landing position within the hoistway. When moved to a safe landing position, the vane contacts the position indicator and is rotated by camming action due to such contact into its second, generally perpendicular orientation, swinging the latch arm and contact plate out of the plane of interference with the lock plate, thereby permitting the elevator door to fully open.

The present invention is preferably integrated with a conventional Otis blade-and roller elevator door/hoistway door coupling mechanism including an elongate engagement blade mounted on the car and extending in the direction of travel of the car, and a coupling member (typically comprising one fixed roller and one movable roller) mounted on each of the hoistway doors. When the interlock of the present invention is integrated into the blade-and-roller coupler (either by modifying the design prior to manufacturing and installing the elevator system, or by retrofitting existing systems), a pivotally movable vane is utilized in place of the blade and simultaneously performs the functions of the fixed blade, as well as the operator function of the car door interlock. The vane is positioned to enter the passageway between the rollers when the elevator car is aligned with the hoistway door for coupling of the car door and the hoistway door. The rollers simultaneously perform the function of a coupling member as well as a position indicator and actuator for the interlock by contacting the vane and providing a cam surface which rotates the vane about its pivoting axis to its clearance orientation generally perpendicular to the surface of the car door, thereby swinging the latch arm and contact plate out of the plane of interference with the lock plate. In this position (i.e., at a landing), the interlock will not engage when the elevator door is opened.

Since the vane is biased away from this perpendicular clearance position when it is not in contact with the hoistway door rollers (i.e., anytime the elevator car is outside a landing zone), the contact plate extends into the plane of the stop plate so that, upon any attempt to open the elevator car door outside a landing zone, the contact plate engages the stop plate after the elevator door has traveled a predetermined minimum distance, typically about four inches, to prevent further opening of the doors.

It will be appreciated that the size of the safe opening zone at each hoistway landing can be established by the length of the vane, as well as by the vertical position of the vane on the elevator car door and/or the position indicator/actuator on the hoistway access door. It will also be appreciated that the pivotal movement of the vane from its engagement position (when not in contact with the hoistway door coupling member) to its disengagement position (when in contact with the hoistway door coupling member) may be designed to require a relatively small angular displacement by varying the length of the latch arm as well as the length of the contact plate.

It will also be appreciated that the interlock of the present invention may be used in a reversed orientation to provide an interlock for hoistway doors when desired. In this reversed orientation, the vane, latch arm and contact plate will be mounted on the inside surface of the hoistway door at each landing for movement between an interference and clearance position with a stop plate mounted in a fixed position with respect to the hoistway opening, and a position indicator/cam surface mounted on the exterior of the elevator car door so that movement of the elevator car into a safe landing zone would actuate the pivotal movement of the vane on the hoistway door thereby moving the contact plate into a clearance position to allow opening of the hoistway door.

Finally, it will be further appreciated that, though the preferred embodiment of the interlock of the present invention is integrated with the components of a conventional elevator door coupling mechanism, it may be alternatively adapted for installation and use independently of the door coupling mechanism.

These and other objects, features, and advantages of the present invention are readily apparent from the following detailed description of the best mode for carrying out the invention when taken in connection with the accompanying drawings.

BRIEF DESCRIPTION OF THE DRAWINGS

FIG. 4 is a partial side view of the elevator car door and hoistway access door with the interlock vane engaged with the hoistway coupling member;

FIG. 5 is a front right perspective view of the interlock vane of the present invention;

BEST MODE FOR CARRYING OUT THE INVENTION

Figure 1:
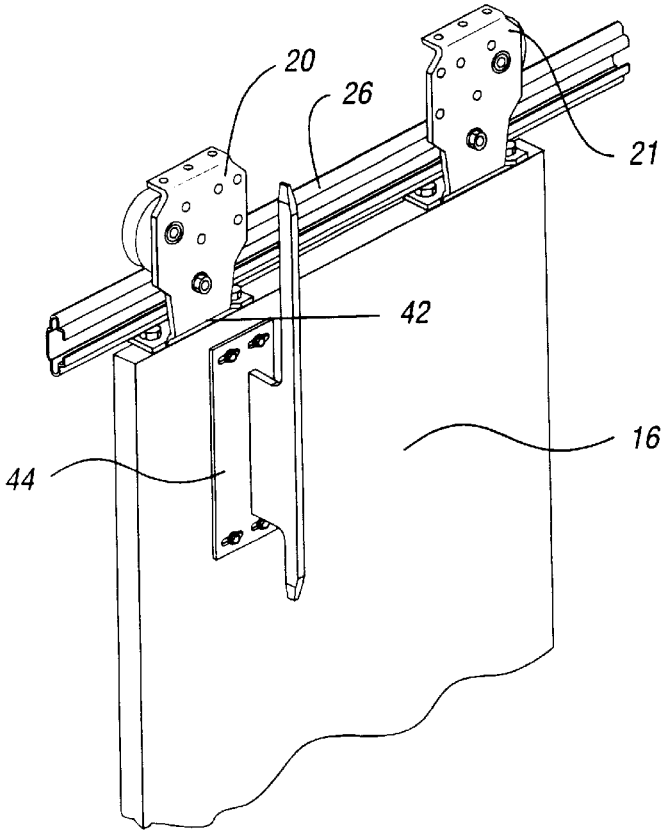
Fig. 1 (PRIOR ART)
FIG. 1 is a front left perspective view of an elevator car door including the conventional blade portion of a blade-and-roller door coupling mechanism.
Figure 2:
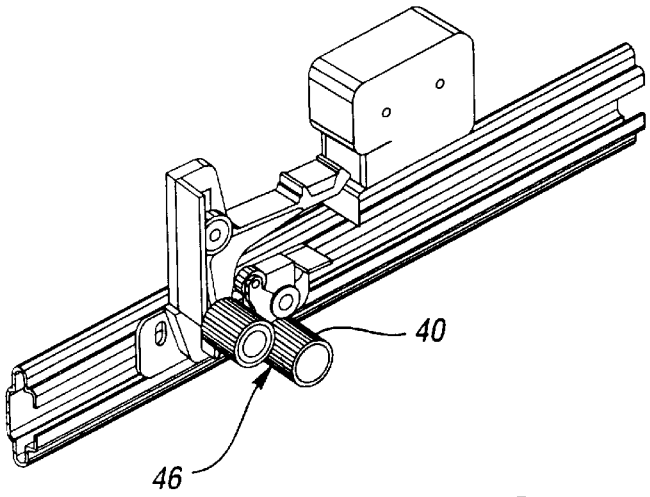
FIG. 2 is a perspective view of the hoistway car door coupling rollers utilized as the access door coupling member in a blade-and-roller type coupling mechanism.

FIGS. 2–10 illustrate an elevator installation 10 including one embodiment of the car door interlock 12 mounted for integral operation in a conventional Otis blade-and-roller-type door coupler. In the embodiment shown, the elevator 10 includes a pair of center-opening car doors 14 and 16 suspended in a conventional manner by hangers 18–21. Grooved wheels 22–25 are mounted, respectively, on hangers 18–21 and are suspended on a guide rail 26 which is mounted on a header (not shown) on the elevator car. At least one of the hangers is operably connected to an actuator (not shown) for powered opening and closing of the elevator car doors 14, 16. The door actuator may be a conventional electro-mechanical drive, or may alternatively comprise a conventional hydraulic door operator of the type disclosed in U.S. Pat. No. 4,910,961, which is commercially available from Vertisys, Inc., the assignee of the present invention. The drive power is, of course, transmitted via a conventional pulley and cable drive assembly to simultaneously open and close both of the center opening doors 14 and 16 of the elevator 10. It will be appreciated that the elevator installation described above is of a conventional type and is shown for illustrative purposes only. As will be described in further detail below, the mechanical car door restraint may be employed with most conventional elevators, either as part of the door coupling mechanism, or as a separate interlock, to provide a simple, effective mechanical lock for the elevator car doors when the car stops out of position.

Figure 3:
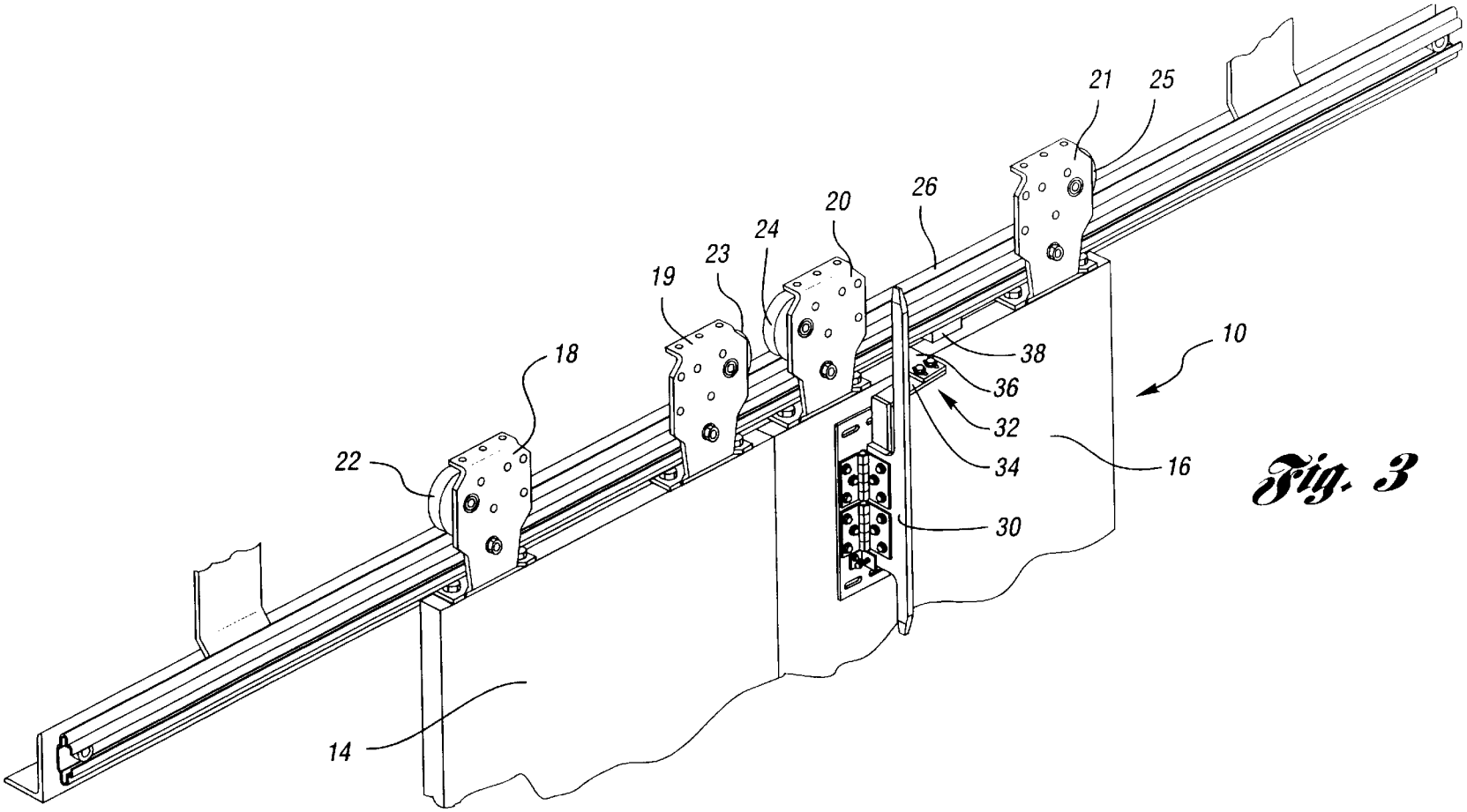
FIG. 3 is a perspective view of an elevator car door including the combined door coupling and interlocking vane of the present invention.
Figure 6:
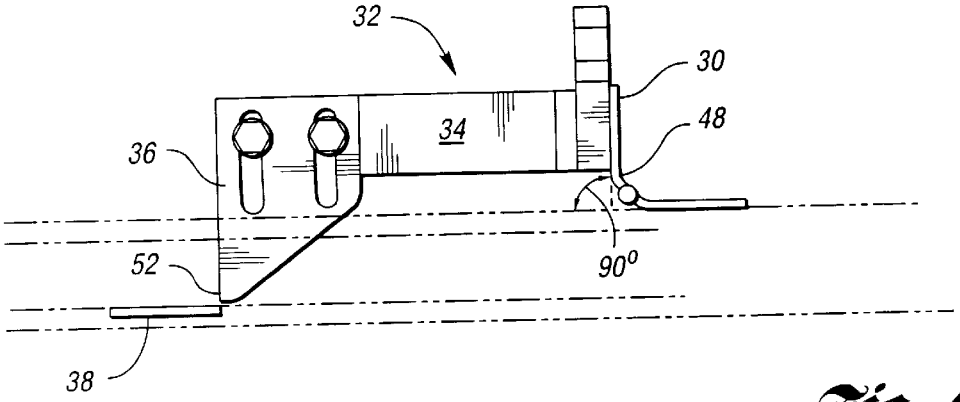
FIG. 6 is a top view of the elevator car door and interlock with the car door partially opened and the interlock in the clearance position.
Figure 7:
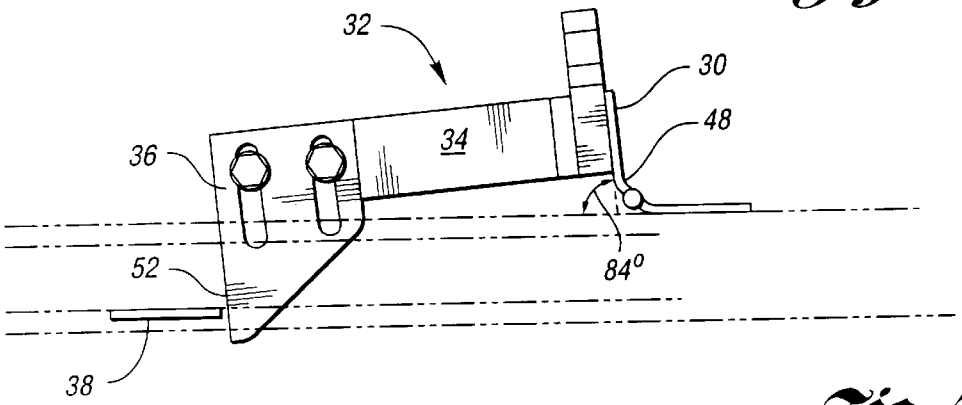
FIG. 7 is a top view of the elevator car door and interlock with the car door partially opened and the interlock in the interference position.

FIGS. 3, 5 and 7 illustrate the interlock in the interference position (when the elevator car door is not at a landing). FIGS. 4 and 6 illustrate the interlock in the clearance position (when the elevator car door is at a landing). In this embodiment, the interlock 12 includes an elongate vane 30 which is pivotally mounted on the outside of the elevator car door 14 for movement between a first position, preferably generally non-perpendicular to the surface of the elevator car door (shown in FIGS. 3, 5 and 7), and a second position, preferably generally perpendicular to the surface of the door 14 (shown in FIGS. 4 and 6). The interlock 12 also includes a swing latch 32 comprising a latch arm 34 and a contact plate 36. A stop plate 38 is mounted in a fixed position with respect to the elevator car, such as on the guide rail 26. The swing latch 32 is fixedly mounted on the vane so that the latch arm moves as the vane is pivoted from its first position (shown in FIG. 7) to the second position (shown in FIG. 6). When the vane is moved to its generally perpendicular position by contact with a position indicator/actuator, such as coupling member 40, on the hoistway door, the latch arm 32 swings into a clearance position shown in FIGS. 3 and 5. In this position, the contact plate 36 does not extend into the plane of the stop plate 38. Thus, in this clearance position, when the elevator door is sliding open, the stop plate does not interfere with the end of the contact plate 36 and the door is allowed to fully open since the elevator car is at a landing.

FIG. 1 illustrates a conventional door coupling mechanism which includes an elongate engagement blade 42 mounted on a base plate 44, which in turn is fixedly mounted on one of the elevator doors 16. In the conventional door coupler, the engagement blade 42 is rigidly mounted on the base plate 44. A coupling member 40, preferably in the form of a pair of rollers(shown in FIG. 2), is mounted on the hoistway doors. The rollers are positioned so that, as the elevator door is vertically positioned at a landing opposite the hoistway doors, the engagement blade 42 passes through passageway 76 between the rollers. Thus, as elevator car door 14 is opening, the passageway 46 between the rollers is constricted so that, if the elevator car is properly aligned at a landing in the hoistway, the engagement blade 42 is securely gripped between the rollers, thereby opening the hoistway door(s) simultaneously with the elevator car doors 14 and 16. In the embodiment of FIGS. 2–10, the interlock of the present invention may be integrated (either prior to installation, or by subsequent retrofit) into the blade-and-roller-type coupling mechanism of FIGS. 1 and 2 by substituting the hinged, rotating vane for the fixed engagement blade, whereby the interlock of the present invention also functions as part of the elevator car door/hoistway door coupling mechanism.

Referring again to FIGS. 3, 5 and 7, the vane 30 is preferably biased in a non-perpendicular position whenever the vane is not in contact with a hoistway door coupling member 40 (i.e., the elevator car is not in a landing zone). In this embodiment, the vane is mounted on the elevator door with at least one spring hinge 48, 50 which biases the vane at an angle of about 6° from perpendicular. The latch arm 34 and contact plate 36 of the swing latch 32 are of suitable dimension such that the spring-biased position of the vane rotates the swing latch 32 so that the end 52 of the contact plate breaks the plane of the stop plate 38, so that any attempt to slide the elevator car door open more than a predetermined distance will result in the contact plate end 52 engaging the stop plate 38, thereby preventing further opening of the door. In the preferred embodiment, the interlock mounted in the latch arm 32 is of suitable size to allow for the elevator car door to be opened approximately four inches before the contact plate 36 engages the stop plate 38 and stops further opening of the door.

In one embodiment, the vane is mounted on a spring-loaded hinge which biases the vane at an angle of about 84° from the surface of the door when the vane is not in contact with the hoistway door rollers, such that rotation of the vane to the disengagement position perpendicular to the surface of the car door provides clearance of the contact plate from the plane of the stop plate. In this embodiment, the latch arm is typically about 6 inches in length, and the contact surface of the contact plate is about 3 inches in length to provide for the desired engagement and disengagement positions resulting from the 6° rotation of the vane for all inch wide elevator doors.

It will be appreciated that the interlock of the present invention is simple in its construction, with relatively few parts, and is designed to be easily installed (i.e. retrofitted) in existing door coupling systems.

Figure 13:
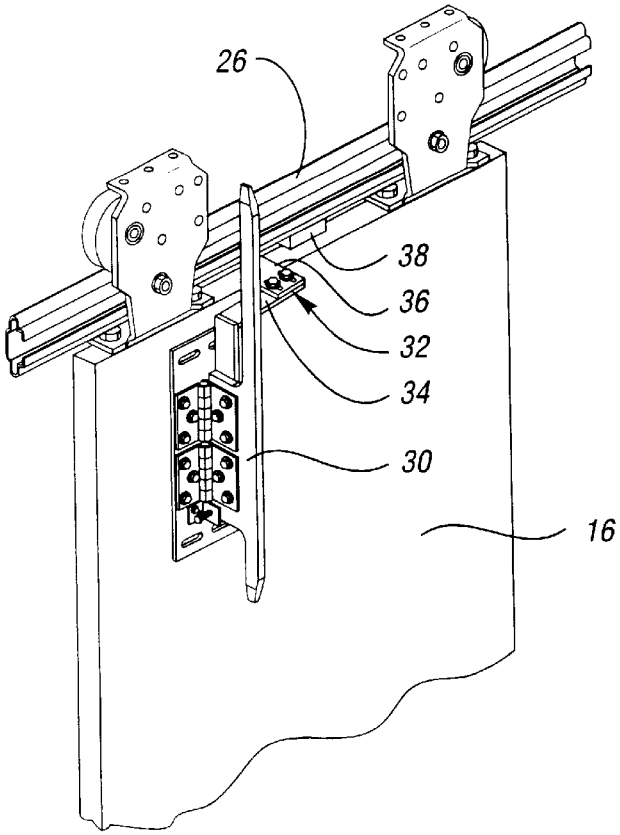
FIG. 13 is a front left perspective view of an elevator car door illustrating another embodiment of the present invention.
Figure 14:
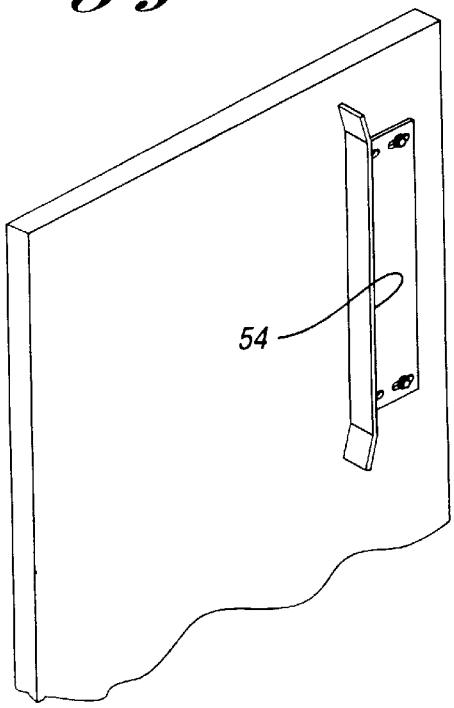
FIG. 14 is a front left perspective view of the hoistway access door including the position indicator/actuator for the interlock shown in FIG. 13.

As shown FIGS. 13 and 14, the interlock may also be installed for use on elevator car doors without integrating it with the door coupling mechanism by providing a position indicator/actuator, such as cam plate 54, at a desired location at each landing, such as on each of the hoistway access doors.

Figure 8:
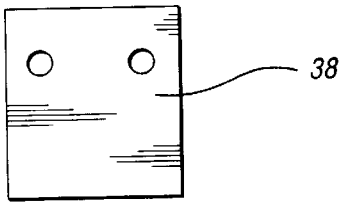
FIG. 8 is a front view of the stop plate.
Figure 10:
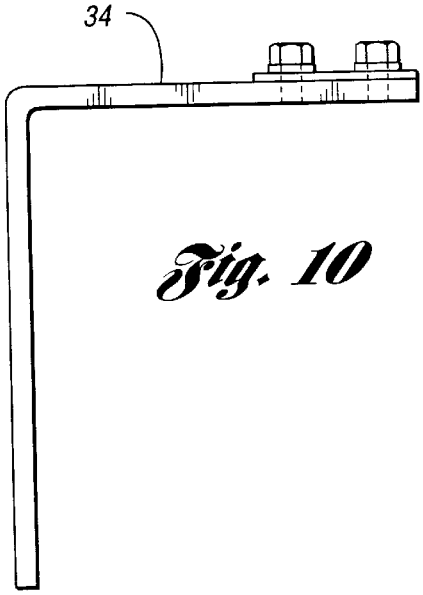
FIG. 10 is a side view of the latch arm and contact plate.
Figure 9:
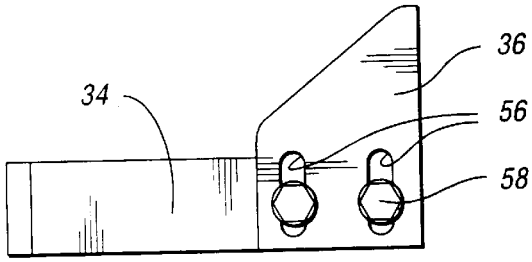
FIG. 9 is a top view of the latch arm and contact plate.

Referring to FIGS. 8–10, the components of the embodiment of FIGS. 2–10 are typically fabricated from aluminum or sheet metal plate. The contact plate 36 may include slotted openings 56 through which the contact plate is adjustably secured to the latch arm 34 by use of conventional fasteners 58, such as bolts. Similarly, the swing latch may be secured to the vane, either by use of conventional fasteners, or by other bonding, such as welding, provided that the swing latch is securely mounted on, and moves integrally with, the pivoting vane 30. Conventional spring hinges, such as part no. 007989, available from Hager, are preferably utilized as hinges 48 and 50, although it will be appreciated that conventional hinges with other biasing members may be utilized, to provide the pivoting mount of the vane and desired non-perpendicular biasing, respectively, without departing from the spirit of the invention.

Figure 11:
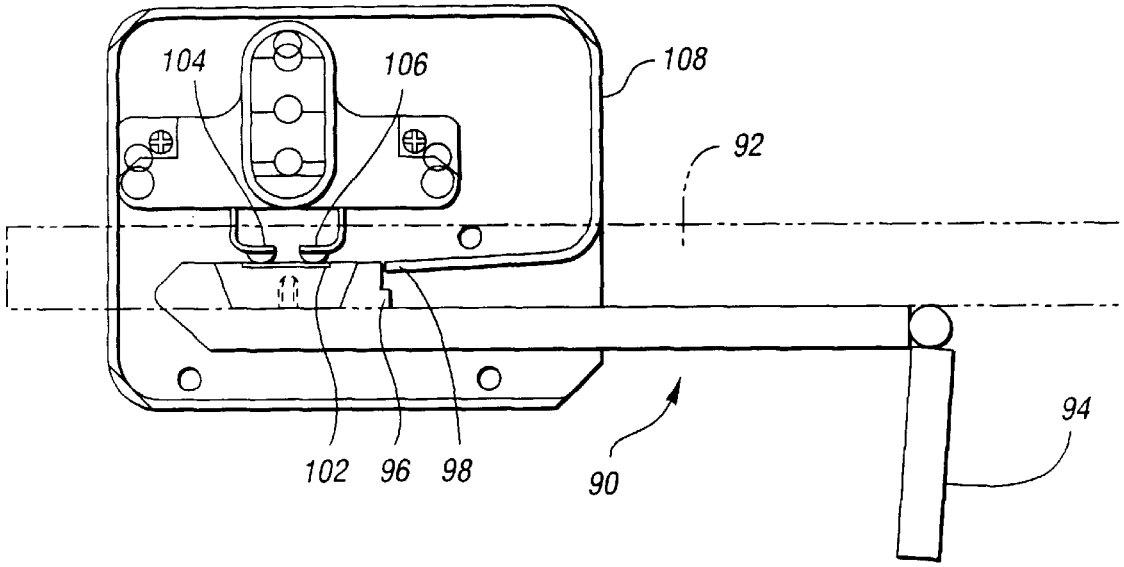
FIG. 11 is a partial top view of another embodiment of the present invention installed as an interlock on a hoistway access door, showing the position of the interlock when the car is not at the landing.
Figure 12:
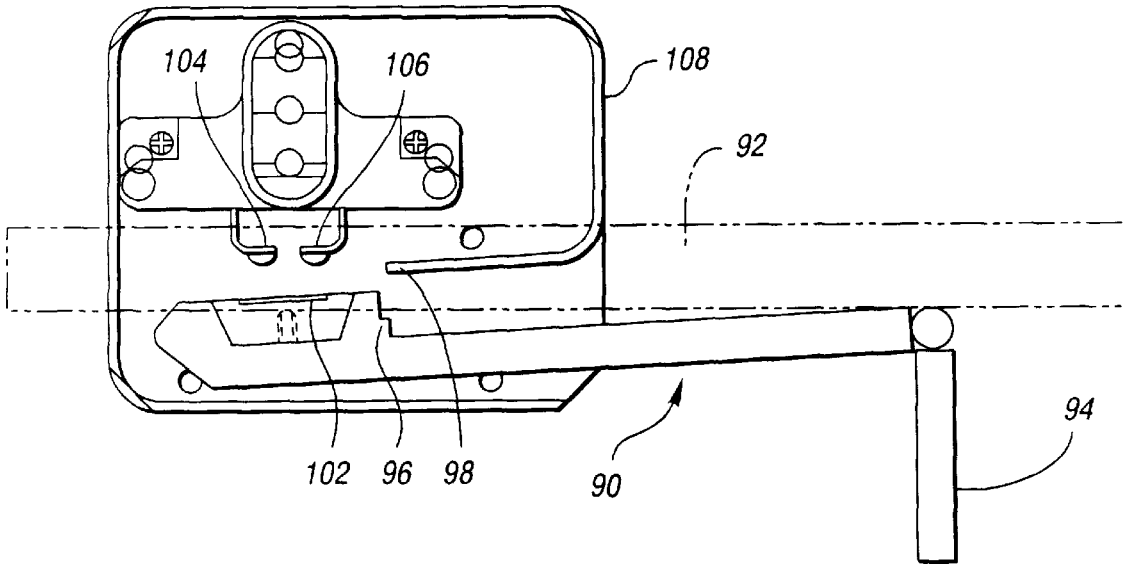
FIG. 12 is a partial top view of another embodiment of the present invention installed as an interlock on a hoistway door, showing the position of the interlock when the car is at the landing.

FIGS. 11 and 12 illustrate another embodiment of the present invention wherein the interlock 90 is utilized on a hoistway door 92. In this embodiment, the vane 94 is pivotally mounted on the inside of the hoistway door 92 at each landing to prevent opening of the hoistway door from outside the hoistway on the landing more than a predetermined distance (again, preferably about 4 inches). In this embodiment, the contact plate 96 extends through the plane of the stop plate 98 and, thus, prevents the hoistway door from opening more than the predetermined distance whenever the vane 94 is in its locking (or interference) position (i.e., whenever the elevator car is not at the landing).

A position indicator/actuator, preferably in the form of a plate (such as cam plate 54 shown in FIG. 14) or roller having a cam surface, is mounted on the inside of the elevator car door in a position which contacts the vane 94 and urges it into a clearance position whenever the elevator car is in position at the landing. At this time, the stop plate 96 is rotated away from the hoistway door a sufficient distance so that, as the hoistway door is slid open, the contact plate 96 clears the stop plate 98 and the hoistway door is allowed to fully open. In the illustrated embodiment, the contact plate preferably includes an electrical contact surface 102 which contacts terminal blocks 104 and 106 whenever the contact plate is in the interference position (i.e., whenever the elevator car is not at the landing). The terminal blocks 104 and 106 are mounted within the interlock housing 108 in a conventional circuit which is suitably connected to the elevator car control. When the circuit is complete (that is, an elevator car is not at the landing door), the interlock is closed, thereby preventing the hoistway door from opening more than about 4 inches, and also allowing for movement of the elevator car in the hoistway. When the interlock has moved to the clearance position (i.e., the car is at this landing), the electrical contact plate 102 does not close the circuit, thereby disabling the elevator car from moving while the hoistway door is cleared to be completely opened for entering and exiting passengers.

It will be appreciated that each of the illustrated embodiments, as well as the other disclosed alternative embodiments of the interlock of the present invention may be quickly and easily moved to the clearance position by someone outside the elevator car, so that the mechanical interlock does not prevent the elevator car door and/or the hoistway do or from being opened when it is determined by qualified personnel that conditions are safe for removal of passengers from the disabled car.

It will also be appreciated that, though the interlock as shown in the embodiments of FIGS. 2–10 installed for operation in an elevator car, and on hoistway doors, of a particular design, the restraint is equally useful and adaptable to other configurations. Again, though the interlock is preferably installed for integrated operation with a blade-and-roller-type elevator car door/hoistway door coupling mechanism, the interlock may also be suitably installed to operate independently of the door coupling mechanism such as is shown in FIGS. 13 and 14. In this embodiment, a position indicator/actuator including a cam surface, such as a cam plate, is mounted at suitable positions at each of the appropriate landings in the hoistway to move the vane of the interlock to the clearance position when desired.

While the best mode for carrying out the invention has been described in detail, those familiar with the art to which this invention relates will recognize various alternative designs and embodiments for practicing the invention as disclosed by the following claims.

What is claimed is:

1. In an elevator system including an elevator car having at least one sliding door, which car travels in a hoistway to(a plurality of landings, wherein at least one landing includes at least one sliding access door, a mechanical elevator car door interlock, the interlock comprising:

an elongate vane pivotally mounted in a fixed position with respect to the elevator car door for movement between a first position and a second position;

a stop plate mounted in a fixed position with respect to the elevator car;

a swing latch mounted on the vane, the swing latch including a latch arm mounted at one end to the vane and extending generally parallel to the surface of the elevator door, and a contact plate mounted on the end of the latch arm opposite the vane for movement from an interference position with respect to the stop plate when the vane is in the first position, to a clearance position when the vane is in the second position; and a position indicator comprising a pair of rollers mounted in a fixed position relative to an access door and defining a vertical passageway through which the elongate vane enters as the elevator car moves into loading and unloading position at the landing, the position indicator including an actuator for contacting the vane as the elevator car moves into the desired position at the landing and urging the vane from its first position to the second position, thereby swinging the contact plate into the clearance position at which time the elevator door may be completely opened.

2. The mechanical elevator car door interlock of claim 1 wherein the elongate vane and position indicator comprise the mechanism for coupling the elevator door to the access door to open and close the access door as the elevator door is opened and closed.

3. The mechanical elevator car door interlock of claim 1 wherein the first position of the vane is generally not perpendicular to the car door surface, and the second position of the vane is generally perpendicular to the car door surface.

4. In an elevator system including an elevator car having at least one sliding door, which car travels in a hoistway to a plurality of landings, wherein at least one landing includes at least one sliding access door, and wherein the elevator door includes a blade-and-roller-type engagement mechanism for coupling the elevator door to an access door to open and close the access door as the elevator door is opened and closed at the landing, a method of integrating a mechanical elevator car door interlock into the elevator system, the method including:

replacing the blade with an elongate vane, wherein the vane is pivotally mounted in a fixed position with respect to the elevator car door for movement between a first position and second position;

mounting a swing latch on the vane, the swing latch including a latch arm mounted at one end to the vane, extending generally perpendicular to the vane, and a contact plate mounted on the end of the latch arm opposite the vane for movement toward and away from the elevator car door; and mounting a stop plate in a fixed position with respect to the elevator car door; whereby the elongate vane serves as a component of the elevator car door/access door coupling mechanism as well as a mechanical interlock which prevents the elevator car door from opening more than a predetermined distance unless the elevator car is position for loading or unloading at a landing.

5. The method of claim 4 wherein the first position of the vane is generally not perpendicular to the car door surface, and the second position of the vane is generally perpendicular to the car door surface.

6. The method of claim 4 wherein the mechanical elevator car door interlock is retrofitted to an existing elevator system.

7. In an elevator system including an elevator car having at least one sliding door, which car travels in a hoistway to a plurality of landings, wherein at least one landing includes at least one sliding access door, a mechanical elevator car door interlock, the interlock comprising:

an elongate vane pivotally mounted in a fixed position with respect to the elevator car door for movement between a first position generally not perpendicular to the car door surface and a second position generally perpendicular to the car door surface;

a swing latch mounted on the vane, the swing latch including a latch arm mounted at one end to the vane and extending generally parallel to the surface of the elevator door, and a contact plate mounted on the end of the latch arm opposite the vane for movement toward and away from the elevator car door;

a stop plate mounted in a fixed position with respect to the elevator car; and a position indicator comprising a pair of rollers mounted in a fixed position with respect to a landing, the position indicator including an actuator for contacting the vane as the elevator car moves into the desired position at the landing and urging the vane from its first, generally non-perpendicular position to the second, generally perpendicular position, thereby swinging the contact plate into a clearance position.

8. The mechanical elevator car door interlock of claim 7 wherein the elongate vane and position indicator comprise the mechanism for coupling the elevator door to the access door to open and close the access door as the elevator door is opened and closed.

* * * * *